United States Patent [19]

Nishikata et al.

[11] 4,143,179

[45] Mar. 6, 1979

[54] METHOD OF MANUFACTURING A KEYBOARD

[75] Inventors: Masumi Nishikata; Kiyoshi Tsugawa, both of Tokyo, Japan

[73] Assignee: Fuji Polymer Industries, Co., Ltd., Tokyo, Japan

[21] Appl. No.: 533,097

[22] Filed: Dec. 16, 1974

[51] Int. Cl.[2] ..... B05D 5/12

[52] U.S. Cl. ..... 427/58; 29/622; 29/625; 29/630 C; 427/152; 427/272; 427/275

[58] Field of Search ..... 427/152, 272, 96, 261, 427/264, 369, 282, 58, 275; 156/234; 29/625, 622, 630 C; 252/514; 428/195, 208

[56] References Cited

U.S. PATENT DOCUMENTS

| | | | |
|---|---|---|---|
| 2,751,315 | 6/1956 | Staehle | 427/369 X |
| 2,776,235 | 1/1957 | Peck | 156/234 |
| 2,914,437 | 11/1959 | Schriner | 156/234 X |
| 3,099,578 | 7/1963 | Hunter | 252/514 X |
| 3,701,317 | 10/1972 | Miyamoto et al. | 252/514 X |

OTHER PUBLICATIONS

Printed Circuit Techniques, National Bureau of Standards Circular 468, Nov. 15, 1947, pp. 12–13.

*Primary Examiner*—Michael F. Esposito
*Assistant Examiner*—Evan K. Lawrence
*Attorney, Agent, or Firm*—Robert L. McKellar

[57] ABSTRACT

A method for manufacturing a keyboard which can be utilized in a keying structure is described. It consists of layering a flat fixed plate with a conductive paint, masking a preformed insulating rubber keyboard, laying the keyboard on the conductive paint surface and thereafter applying pressure to the rubber keyboard to the extent that certain portions of the rubber keyboard are put in contact with the conductive paint.

4 Claims, 6 Drawing Figures

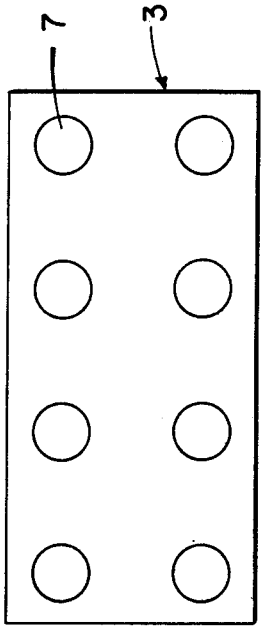
Fig. 2
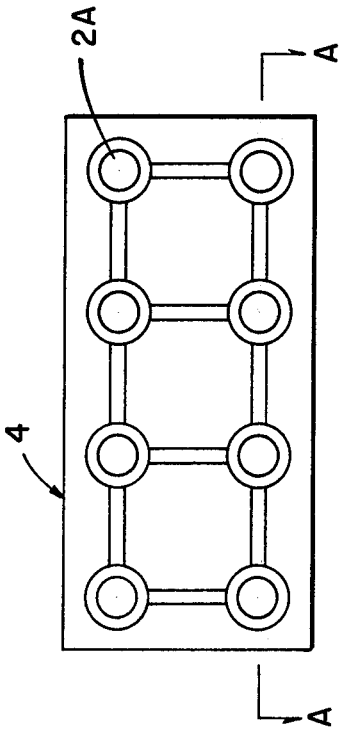
Fig. 1
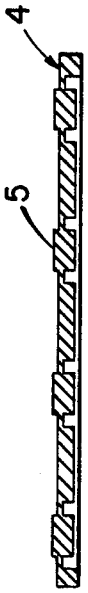
Fig. 1A
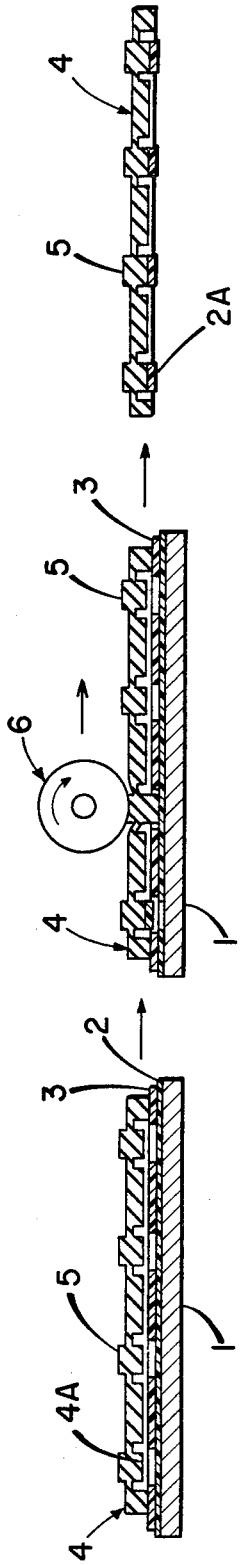
Fig. 5
Fig. 4
Fig. 3

METHOD OF MANUFACTURING A KEYBOARD

BACKGROUND OF THE INVENTION

Rubber keyboards for keyed structures are not new. Neither are rubber keyboards having electrically conductive portions thereon. There are problems, however, associated with the currently used keyboards as well as problems associated with their production.

Prior art keyboards are manufactured by joining a contact material, i.e., an electrically conductive material which has been fashioned beforehand, with a keyboard which is either made of non-conductive material or is coated with non-conductive material.

In a particular method, a large number of small contact members are press formed by molding in metal molds. The contact members are thereafter affixed to the keyboard, thus constituting a two-step method of manufacture which is not only complicated but is time consuming. In order to overcome the difficulties attendant in such an operation, this invention was conceived and reduced to practice.

SUMMARY OF THE INVENTION

This invention relates to a method of manufacturing a keyboard which is useful in keying structures. More particularly, this invention relates to a rubber keyboard which is useful in keying structures such as miniature, hand-held computers and calculators.

The method of this invention comprises layering a flat fixed plate with a thin layer of electrically conductive paint, masking a preformed insulating rubber keyboard, laying the so masked keyboard on the conductive paint and applying pressure to the rubber keyboard to the extent that certain portions of the rubber keyboard are pressed downwardly into contact with the electrically conductive paint.

It is an object of this invention to produce insulating rubber keyboards in a method whereby the cumbersome and timeconsuming method of attaching contact points to rubber keyboards is not encountered.

It is also an object of this invention to produce insulating rubber keyboards that are more uniform in structure and have uniform contact points which give rise to a lesser number of rejects and a lesser number of malfunctioning machines in which the keyboards are ultimately used.

It is a further object of this invention to speed-up the mass production of keyboard units and cut down on the expense of labor and machinery for an otherwise expensive process.

Pursuant to the above and other objectives, the invention will now be described in greater detail.

BRIEF DESCRIPTION OF THE DRAWINGS

In the drawings, FIG. 1 is a plan view of the under portion of the finished keyboard showing the contact points 2A and the silicone rubber support material 4;

FIG. 1A is a cross-sectional view of the keyboard taken along the plane A—A;

FIG. 2 is a top plan view of the masking shield 3 with the requisite openings 7 through which the portion of rubber 4A passes to reach the electrically conductive paint;

FIGS. 3 and 4 show a cross-sectional view of the keyboard taken along the plane A—A shown in FIG. 1 and the apparatus used in manufacture during the various steps of the manufacture;

FIG. 5 is a cross-sectional view along plane A—A of the finished article showing the rubber support material 4 and the contact thereupon, 2A.

DESCRIPTION OF THE PREFERRED EMBODIMENTS

Referring now to the drawings wherein like reference characters designate like or corresponding parts throughout the figures thereof, there is shown in FIG. 3 a cross-sectional view of a portion of the manufacturing apparatus and article of this invention. The invention requires a flat fixed plate 1 which is at least as wide as the width of the rubber keyboard which is to be manufactured. Layered on the surface of the flat fixed plate is an electrically conductive paint 2. Shown above the components 1 and 2 are components 3 and 4, which are shown in plan view in FIGS. 2 and 1, respectively. The component 3 is a masking shield which protects the surfaces of the insulating rubber keyboard 4 which are not to be coated with the electrically conductive paint 2. The masking shield 3 is generally affixed to the rubber keyboard before the whole is surmounted on the electrically conductive paint surface, although the affixing of the masking shield is not essential and the masking shield can be placed directly on the paint surface and the rubber keyboard thereafter placed thereon. The rubber keyboard 4 is preformed from a resilient material, which resilience is necessary for the satisfactory operation of the finished part as well as for the satisfactory operation of the instant method. Note that the manufacture of the preformed rubber keyboard itself is not part of this invention. Note also that the rubber keyboard is manufactured with small rubber dimples 5 on its upper surface. These dimples correspond directly with the rubber portion 4A which is to become the contact 2A.

Referring now to FIG. 4, there is shown a cross-sectional view of the same portion of apparatus as is shown in FIG. 3. The components 1, 2, 3 and 4 are in the proper position for the application of pressure. The pressure is supplied by a roller 6 which passes over the components 1 through 4 and causes the portions 4A to be pushed downwardly into the conductive paint surface. Note that the rubber dimples 5 enhance the pressure of the roller at that point thereby causing the portions 4A to reach the paint surface without undue pressure on the remainder of the rubber keyboard that is not intended to be coated. Note also that the invention is not restricted to that portion of the invention where the roller is passed over the components 1 through 4. Contemplated within the scope of the invention is the situation where the components 1 through 4 are passed under a stationary roller, and mass production can be accomplished under such conditions by providing the components in the form of a moving belt which is later cut into segments.

Immediately after the passage of the roller, the resilient rubber keyboard, portion 4A, springs back to its normal configuration and the portion 4A is now coated with the electrically conductive paint. The finished keyboard is then set aside to dry or cure, as the case may be, to form the contact 2A.

Note that the drawings show 3 or 4 dimples 5 or 3 or 4 portions 4A but this is just for convenience in drawing and illustrating the invention. The number of such dimples 5 and portions 4A are not intended to be restricted to any certain number but are intended to be limited by practicality and need.

As mentioned supra, the insulating rubber keyboard 4 is preformed and the process and article thereby are not intended to be encompassed by this invention. The rubber keyboard can be any resilient rubber material which has electrical insulating properties. Preferred for this invention are curable silicone rubbers. Silicone rubbers are well known in the art and are well known to be electrically insulative. For those unfamiliar with such silicone rubbers, attention is directed to U.S. Pat. Nos. 2,823,218; 3,159,601; 3,188,299 and 3,192,181. Also known are silicone rubbers that cure by the action of peroxide catalysis on unsaturated groups on silicon.

The electrically conductive paint can be a commercial paint containing a resin, pigments, conductive particles and solvents or the electrically conductive paint can be a rubber dispersion in water or solvent, said dispersion also containing pigments and/or conductive particles.

Preferred for this invention are silicone rubber dispersions containing electrically conductive particles or pigments. The amount of electrically conductive paint that is layered on the flat fixed plate 1 can vary according to the desired end use of the finished product. For most uses, however, the layer of electrically conductive paint on the surface of the fixed flat plate should be 1 to 2 mm. thick in its uncured state. Depending upon the dilution of the base resin or rubber in the paint solution, this amount of electrically conductive paint gives a contact point, when dried, of 0.5 to 2 mm. thick. Layers of electrically conductive paint which give in excess of 10 mm. in thickness are usually not practical for this invention. Furthermore, layers of electrically conductive paint which give less than 0.05 mm. in thickness are also usually not practical for this invention.

As noted earlier, the pressure necessary for the portion 4A to contact the wet electrically conductive paint is provided by way of a roller. Roller means are common in the art and no further elaboration is required.

While the invention has been particularly shown and described with reference to specific embodiments, it is to be understood by those skilled in the art what various changes in form and detail may be made without departing from the spirit and scope of the invention.

That which is claimed is:

1. A method of manufacturing a keyboard which is useful in keying structures wherein a resilient preformed insulating rubber keyboard is coated with electrically conductive paint at specific locations on the keyboard, to form a conductive contact, the method consisting of spreading a thin layer of electrically conductive paint on a flat fixed plate;

surmounting the electrically conductive paint with a masking shield;

surmounting the masking shield with said preformed insulating rubber keyboard;

contacting the preformed insulating rubber keyboard with pressure means, whereupon those portions of the preformed rubber keyboard which are not masked are forced downwardly into intimate contact with the electrically conductive paint causing the paint to adhere to the peformed ruber keyboard, thereafter releasing the pressure means, and allowing the electrically conductive paint to dry.

2. The method of claim 1 wherein said pressure means is a roller.

3. The method of claim 2 wherein the resilient preformed insulating rubber keyboard consists of cured silicone rubber.

4. The method of claim 3 wherein the electrically conductive paint is a silicone paint.

* * * * *

UNITED STATES PATENT AND TRADEMARK OFFICE

CERTIFICATE OF CORRECTION

PATENT NO. : 4,143,179

DATED : March 6, 1979

INVENTOR(S) : MASUMI NISHIKATA ET AL

It is certified that error appears in the above-identified patent and that said Letters Patent are hereby corrected as shown below:

Column 4, line 5, "what" should read --that--

Column 4, line 27, "ruber" should read --rubber--

Signed and Sealed this

*Twenty-eighth* Day of *August 1979*

[SEAL]

*Attest:*

*Attesting Officer*

LUTRELLE F. PARKER

*Acting Commissioner of Patents and Trademarks*